US009386874B2

(12) United States Patent
Benjamin

(10) Patent No.: US 9,386,874 B2
(45) Date of Patent: Jul. 12, 2016

(54) MULTIPURPOSE TOOL FOR DRESSING ASSISTANCE AND METHODS OF USE

(71) Applicant: Sheila B. Benjamin, Philadelphia, PA (US)

(72) Inventor: Sheila B. Benjamin, Philadelphia, PA (US)

( * ) Notice: Subject to any disclaimer, the term of this patent is extended or adjusted under 35 U.S.C. 154(b) by 0 days.

(21) Appl. No.: 14/714,090

(22) Filed: May 15, 2015

(65) Prior Publication Data

US 2015/0245725 A1 Sep. 3, 2015

Related U.S. Application Data

(60) Provisional application No. 62/078,414, filed on Nov. 12, 2014.

(51) Int. Cl.

| | |
|---|---|
| ***A44B 19/00*** | (2006.01) |
| ***A47G 25/90*** | (2006.01) |
| ***A47G 25/92*** | (2006.01) |

(52) U.S. Cl.

CPC ..... *A47G 25/902* (2013.01); *A47G 25/92* (2013.01); *Y10T 24/17* (2015.01); *Y10T 29/4984* (2015.01)

(58) Field of Classification Search

CPC ..... A47G 25/902
USPC ..... 294/3.6, 26; 24/40, 430, 429; 29/434; 223/111; 224/269
See application file for complete search history.

(56) References Cited

U.S. PATENT DOCUMENTS

| | | | | | |
|---|---|---|---|---|---|
| 16,766 | A | * | 3/1857 | Brittin | C12C 7/17 24/40 |
| 177,197 | A | * | 5/1876 | Brougham | A47G 25/92 24/40 |
| 386,851 | A | * | 7/1888 | Schreidt | B21D 51/24 29/434 |
| 416,932 | A | * | 12/1889 | Mabie | A47G 25/92 24/40 |
| 583,398 | A | * | 5/1897 | Holmgren | A47G 25/92 24/40 |
| 1,067,362 | A | * | 7/1913 | Miller, Jr. | B23P 11/00 29/434 |
| 1,194,381 | A | * | 8/1916 | Harding | A47G 25/92 24/40 |
| 2,018,344 | A | * | 10/1935 | Bratz | F16C 1/14 29/434 |
| 2,443,712 | A | * | 6/1948 | Alldredge | B21K 1/76 29/434 |
| 3,276,087 | A | | 10/1966 | Hanson | |
| D296,882 | S | * | 7/1988 | Lopez | D11/221 |
| 5,007,155 | A | * | 4/1991 | Jordan | B25B 27/023 29/434 |
| 5,008,985 | A | * | 4/1991 | Thompson | A44B 19/301 294/3.6 |
| 5,093,966 | A | * | 3/1992 | Yuki | A44B 19/262 24/419 |
| 5,100,191 | A | | 3/1992 | Detrick et al. | |
| 5,915,632 | A | * | 6/1999 | Muratsubaki | A44B 19/26 24/419 |
| D415,061 | S | | 10/1999 | Lamacchia et al. | |
| 5,975,386 | A | * | 11/1999 | Fernicola | A47G 25/902 294/3.6 |
| D435,328 | S | | 12/2000 | Harris et al. | |
| D476,136 | S | * | 6/2003 | Nahum | D2/643 |

FOREIGN PATENT DOCUMENTS

| | | |
|---|---|---|
| EP | 0761117 | 3/1997 |
| WO | WO/2004/100695 | 11/2004 |
| WO | WO/2008/054317 | 5/2008 |

* cited by examiner

*Primary Examiner* — Paul T Chin
(74) *Attorney, Agent, or Firm* — CIONCA Law Group P.C.; Marin Cionca

(57) ABSTRACT

Applicant conducted a brief telephonic interview with the Examiner on Apr. 29, 2016, and clarified that the abstract needs no amendment. Examiner agreed that the corrections requested on page 2 of the Office Action are not needed.

12 Claims, 6 Drawing Sheets

*Fig. 7*

*Fig. 1A*
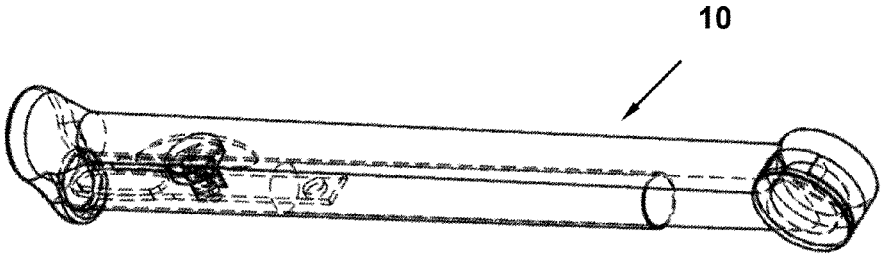
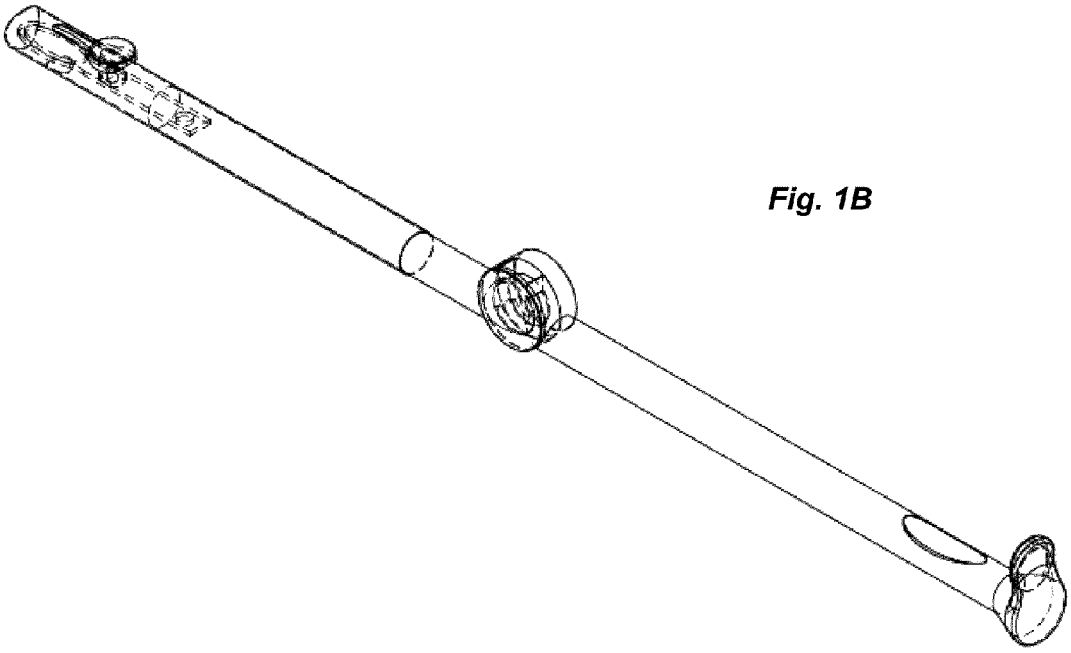
*Fig. 1B*

MULTIPURPOSE TOOL FOR DRESSING ASSISTANCE AND METHODS OF USE

CROSS-REFERENCE TO RELATED APPLICATIONS

This application claims the benefit of U.S. Provisional Application No. 62/078,414, filed Nov. 12, 2014, which is hereby incorporated by reference, to the extent that it is not conflicting with the present application.

BACKGROUND OF THE INVENTION

1. Field of the Invention

The invention relates generally to personal assistance devices, tools and methods and more particularly to a multipurpose tool for use in personal functions, such as the arrangement and closure of garments during dressing, and to methods of operation and use of the same.

2. Description of the Related Art

Fastening mechanisms such as tabs, buttons, slides, and zippers are commonly used on many articles including food and beverage containers, storage containers, luggage and personal items, and articles of clothing and footwear. However, there are certain circumstances where it is quite difficult for a person to properly manipulate these mechanisms or parts thereof.

For example, the person may have a physical condition that makes this task difficult. Conditions that affect negatively an individual's capacity to manipulate small objects, whether in the front or in the back of the individual, include, but are not limited to: carpal-tunnel syndrome, wrist and forearm fractures, shoulder problems or inflexibility, malformations due to birth defects or injury, amputations, wearing casts or bandages, multiple sclerosis, muscular dystrophy, cerebral palsy, quadriplegia, diabetes, fingernails that are too long or too short, as well as the side effects of many medications that cause the loss of the sensation of touch and/or grip strength.

As another example, even when the person is completely healthy and physically capable, when these mechanisms are located in hard to reach places such as in the back of the person (e.g., a zipper on the back of a dress), manipulating them becomes difficult if not impossible and often the aid of another person is needed to do so. When the other person is not available, the task may be impossible.

Thus, for healthy people alike, but especially for people with restrictions in mobility, strength or diminished sensation in their fingers, etc. or who for a variety of other reasons and circumstances may wish to avail themselves of the use of a tool that can make the operation of for example a zipper, closure of a button, or pulling of a tab easier and not dependent on the assistance of another person, there is a need for a multipurpose tool that can meet that need.

BRIEF SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an embodiment, it is provided a multipurpose foldable personal use tool with a manually operated cinching loop mechanism, useful for example as a zipper pulling tool or button closing tool, which tool is of a dimension when closed/folded and another when open, and which can be easily transported by the user within a pocket or bag in folded state. The dimensions of the multipurpose tool may be altered according to the intended type of object to be pulled such as a zipper, button or tab.

In an aspect of the invention, a kit containing the multipurpose tool of the invention is provided, together with instructions for use, packaging material, and, optionally, a container for use when transporting or storing the personal use tool. The container may be of a soft material or may be comprised of a rigid material.

In another embodiment, a method for using the multipurpose personal use tool is provided. The method of using the multipurpose personal use tool having a handle and an arm with a cinching loop assembly comprising the steps of: opening the tool by extending the arm away from the handle, encompassing a pull tab of a zipper or a button to be pulled with the loop affixed to the tool, cinching the loop tightly around the zipper pull tab, and exerting force on the handle to move the zipper pull tab along the direction of the zipper desired so as to zip or unzip the zipper or to move the button through a hole.

Thus, it is an object of the invention to provide a multipurpose tool that facilitates the manipulation of for example a zipper, a button, or a tab.

It is still another object of the invention to provide a tool that is relatively inexpensive, portable, and easy to use.

The above embodiments, aspects, objects and advantages, as well as other embodiments, aspects, objects and advantages, will become apparent from the ensuing description and accompanying drawings.

BRIEF DESCRIPTION OF THE DRAWINGS

For exemplification purposes, and not for limitation purposes, embodiments of the invention are illustrated in the figures of the accompanying drawings, in which:

FIGS. 1A-B show perspective views of the multipurpose tool in closed position (A) and in open position (B), respectively, according to several embodiments.

DETAILED DESCRIPTION OF THE PREFERRED EMBODIMENTS

Figure 2:
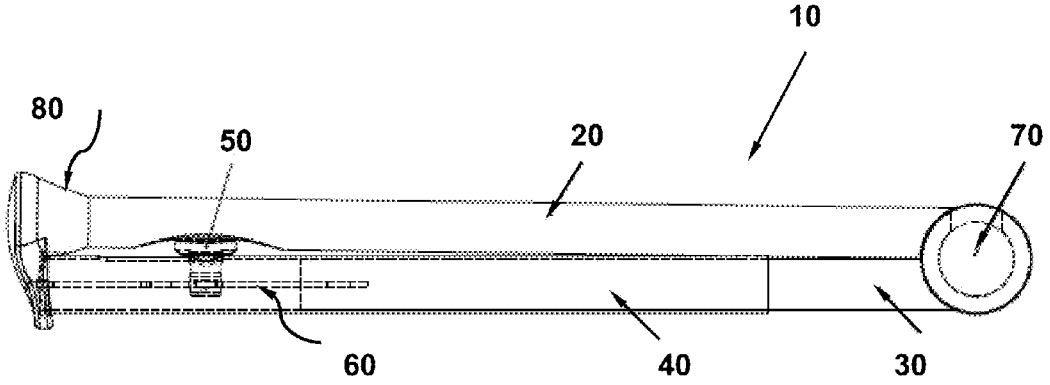
FIG. 2 shows a side view of the multipurpose tool from FIG. 1A.

What follows is a detailed description of the preferred embodiments of the invention in which the invention may be practiced. Reference will be made to the attached drawings, and the information included in the drawings is part of this detailed description. The specific preferred embodiments of the invention, which will be described herein, are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

For the following description, it can be assumed that most correspondingly labeled elements across the figures (e.g., 20, etc.) possess the same characteristics and are subject to the same structure and function. If there is a difference between correspondingly labeled elements that is not pointed out, and this difference results in a non-corresponding structure or function of an element for a particular embodiment, then the conflicting description given for that particular embodiment shall govern.

In an embodiment, the invention comprises a multipurpose tool for personal use in for example closing garments including pulling zippers and fastening buttons. In an embodiment, the tool comprises a cinching loop assembly that will hold fast the zipper tab or other tabs or the button while the garment is being put on, if necessary, and an extending handle allowing the user to position the handle easily so that it will operate the zipper for example along its length. In one embodiment, the multipurpose assistance tool comprises a handle which articulates with an arm comprising a loop, which loop can encompass a zipper tab or a button, which loop is further capable of being mechanically cinched around the base of the zipper tab or means by which the button is affixed to a garment, whereby the tool can be used to pull the zipper slide or fasten the button.

In an embodiment, the handle of the multipurpose assistance tool extends from the cinching loop assembly comprising an arm hinged to the handle. In an embodiment the hinge connecting the handle and the arm are formed from molded features on the handle and the arm that fit to each other in such a manner as to permit motion only in one plane. In one embodiment, the hinge is a barrel hinge or a shortened barrel hinge or a circular hinge. In other embodiments, the hinge may be of a type allowing extension and lateral rotation such as a hinge which is a ball and socket or, alternatively, a pivot joint. In another embodiment, the handle may have multiple sections hingedly connected so that it may form a smaller dimension when closed. In one embodiment, the hinge is constructed with a stop so as to limit the degree of movement in on direction.

Reference will now be made to FIGS. 1A and 1B and FIG. 2 showing the multipurpose assistance tool 10 in accordance with an embodiment. FIG. 1A shows the multipurpose assistance tool in the closed position and FIG. 1B shows the multipurpose assistance tool in the open or fully extended position. As shown in FIG. 2, an embodiment of the zipper assistance tool comprises a handle 20 preferably hingeably connected by circular hinge 70 to arm 30 to which metal plate 60 is preferably associated and which is partially enclosed by slide tube 40. In the embodiment shown, optional cap piece 80 (see FIG. 5) acts to engage the open end of slide tube 40 where the slide tube encloses the metal plate at the end of arm 30.

Figure 3:
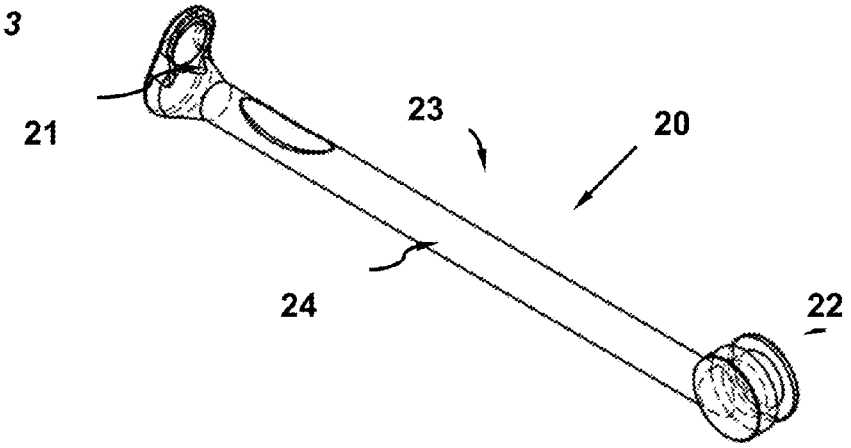
FIG. 3 shows a perspective view of the handle piece of the multipurpose tool of FIG. 1A.
Figure 4:
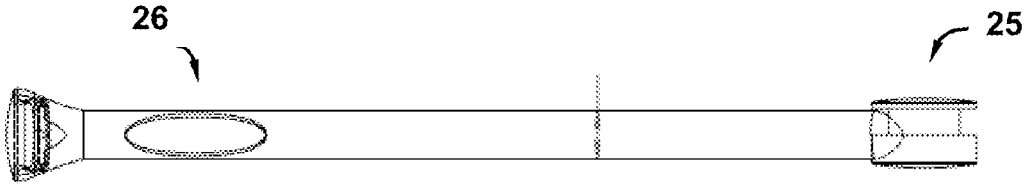
FIG. 4 shows a bottom view of the handle piece of the multipurpose tool of FIG. 1A.
Figure 5:
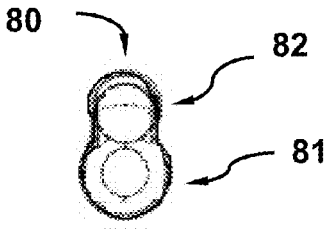
FIG. 5 shows a front view of the cap of the handle piece of the multipurpose tool of FIG. 1A.

Referring to FIGS. 3 and 4, pull handle 20 may be substantially rod shaped along its center length with a proximal end 21 and a distal end 22. A hinge forming component 25 is mounted at its distal end. The handle has a front surface 23 and a back surface 24 which become the inner and outer surfaces, respectively, when the tool is in the closed position. The front surface has depression 26 (FIG. 4) which forms a space for receiving button 50 when the tool is in the closed position. Referring to FIG. 5, cap 80 is comprised of a head 81 and a lip 82.

Figure 6:
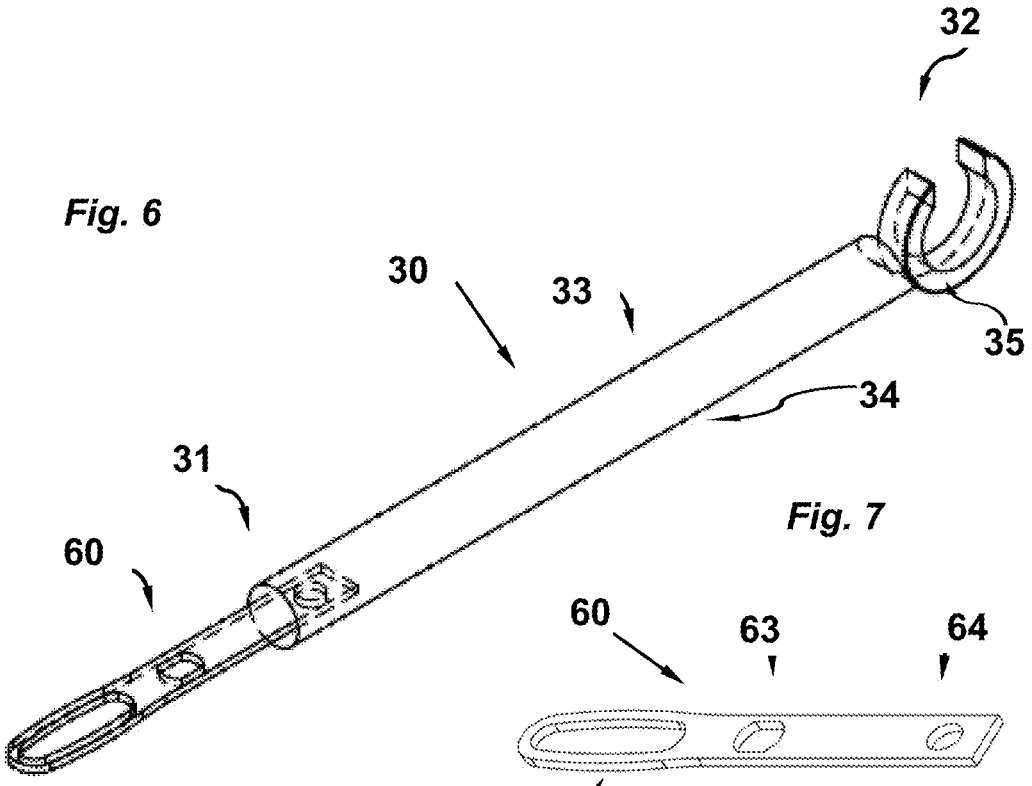
FIG. 6 shows a perspective view of the arm and associated metal plate of the multipurpose tool of FIG. 1A.
Figure 8:
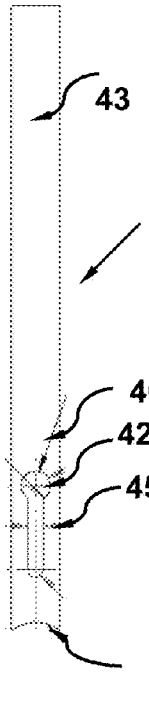
FIG. 8 shows a top view of the slide tube of the multipurpose tool of FIG. 1A.
Figure 9A:
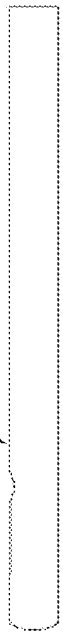
FIGS. 9A-B show side views of the slide tube of the multipurpose tool of FIG. 1A.

Referring to FIG. 6, arm 30 is substantially rod shaped along its center length with a proximal end 31 and a distal end 32 and an inner surface 33 and an outer surface 34. A hinge forming component 35 is mounted at its distal end. The arm member is rod shaped which allows it to be encased by slide tube 40 (FIGS. 8 and 9) being of a similar shape and having an inner dimension larger than the outer dimension of the arm. Slide tube 40 is of an outer dimension such that arm 30 and associated plate 60 may slide therewithin. Slide tube 40 is held in association with arm 30 by button 50 which connects through an opening in the slide tube to plate 60, where plate 60 is preferably fixedly associated with the arm 30. The arm 30 is capable of movement in a transverse direction to the handle 20 by movement around the hinge 70 formed by articulation of hinge elements 25 and 35 at the distal end 22 of the handle and the distal end 32 of the arm to form a circular hinge. Arm 30 has a proximal end 31 opposite the end comprising the hinge forming element within which is preferably fixedly attached plate 60.

It should be noted that whereby the arm being hingeably connected to the handle at the distal end, such that the arm and handle can be opened to various degrees to obtain corresponding lengths of the tool and corresponding angles between the arm and the handle, to accommodate the fastening mechanism's location, provides an important advantage. For example, when the tool is used to fasten a zipper on the back of one's dress, the handle may be at a ninety degrees angle with the arm, thus making it easier to pull the handle over the person's shoulder forward, instead of upwards, which may be difficult if not impossible for a person with mobility issues.

In an embodiment, the handle 20 has an inner surface 23 and an outer surface 24. The outer surface 24 can be smooth as shown in FIG. 1, or can be formed with curved indentations, ridges or having a non-slippery surface to allow a better grip by the fingers of the user. The handle portion of the tool may take on different shapes and more round or more flat as desired. In one embodiment it is round. In one embodiment the length of the handle is comprised of a material that is flexible such that it may be bent around the curve of the body of the user while in use. In one embodiment, the handle is made of Elastomer-80 durometer material.

Figure 7:
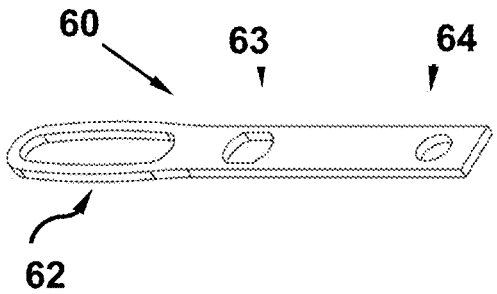
FIG. 7 shows a perspective view of the metal plate that is associated with the arm of the multipurpose tool of FIG. 1A.

The cinching loop assembly, is comprised of a loop which is shortened or "cinched" by the movement of a slideable sheath over the arm and loop. In an embodiment as shown in FIG. 1B, plate 60 (FIG. 7), which comprises loop 62 extends into arm 30 for approximately one-half the length of the rod shaped arm and is rigidly fixed therewithin. The width of the arm and the plate are similar and are of a dimension in relation to the inner dimension of the slide tube such that lateral movement is minimized and the edges of the plate slide easily within the slide tube. In an embodiment of the invention as shown in FIG. 1B, the slide tube open end 41 has a contour cut in the same dimension as the flat surface of the metal plate and loop 62. Having a contour cut at the end of the slide tube, provides a means to more readily access the void space of the loop as well as forming a larger dimension across the space formed after the loop and slide tube engaged to maximally cinched around the object to be pulled. The slide tube is manufactured using a material of sufficient durability to be able to repeatedly engage and pull an object. In one embodiment, the slide tube is fabricated of stainless steel.

In an alternate embodiment, the cinching loop assembly is comprised of a loop and arm assembly where the loop is made of a nonmetallic material and may have a degree of deformability, such as being made from a woven material, e.g. a cord, or a polymeric material. Any suitable means may be used to associate the loop 62 to the proximal end 31 of the arm 30, which may be round or flat or other shape, so long as it is slidably engaged by the sheath/slideable member that functions to cinch the loop around the object to be pulled.

Figure 9B:
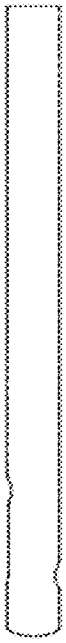
Figure 10:
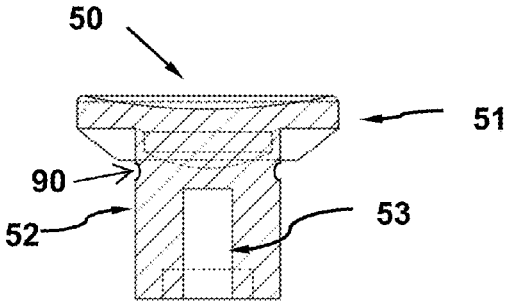
FIG. 10 shows a sectional view of the push button of the multipurpose tool of FIG. 1A.

Button 50 (FIG. 10) may be inserted into plate 60 (FIG. 7) at hole 63 via a cutout on the inner surface 46 of slide tube 40. The means of affixing button 50 to plate 60 may be by a variety of means, such as a pop rivet, a screw inserted into the center of bore 53 of the button through a cut out in the surface transverse to the surface where it is inserted or the outer surface of slide tube 40, as shown in FIG. 9B as opening 48; also by gluing, welding or other suitable and stable means. Slide tube 40 is moved along arm 30 and button 50 by the actuation of button 50 which is connected to plate 60.

In one embodiment of a multipurpose assisting tool as shown in FIG. 1B, the slot 45 extends into the first side surface 43 of slide tube 40 for a distance approximately equal to one-half the length of plate 60. Preferably, the slot 45 has a width that allows the stem 52, and even more preferably only the narrower/neck portion 90 of stem 52 situated right below cap 51 of button 50, to easily but snuggly slide along the length of slot 45. At the end of the slot 45, as shown, there is an opening 46, which preferably allows the button stem 52 to emerge when pressure on the button 50 is released, thereby allowing the elastic, spring-like deformation of the metal plate 60 to be relaxed. Once in the hole portion 46 of the keyhole cutout 42, the button may lock in the hole when, with the exception of the neck portion 90, the diameter of the button stem 52 fitting snuggly in the hole is larger than the width of the slot 45. Then, the button 50 will have to be pressed down and forward, so that the neck portion 90 can slide through slot 45, to expose the loop 62. In an embodiment, the slot 45 will have a width of 0.5 to 15 mm. In one embodiment of a multipurpose assisting tool as shown in FIG. 1B and referring to FIG. 8, the keyhole cutout 42 is transversely located to dimension of contour cut of slide tube 30 and the beginning from about 10 to about 15 mm for edge of tube and hole 46 of the keyhole shape, has a radius of about 3 mm or about 6 mm wide and slot 45 has a width which is about 3 mm wide and extends a length from the hole shape towards the open contour end of the slide tube which is about the same dimension as the length of loop 62 in metal plate 60.

Pressure applied to button cap 51 as described above moves the button from the round hole 46 of keyhole cutout 42 of the slide tube down the narrow portion 45 of the keyhole 42, so as to slidably move button 50 towards the open end of slide tube 40 thereby moving slide tube 40 along arm 30 and exposing loop 62. The movement of button 50 is preferably restricted when the multipurpose assisting tool 10 is in the closed or non-operating position. Button 50 is preferably accessible when the multipurpose assisting tool is open and in the operating position. By moving button 50 towards the open end of the slide tube, the pull loop 62 is exposed from the contour end of slide tube 40 and ready for service. Once the loop is engaged with for example a zipper pull tab, button 50 is returned along slot 45 to secure the zipper pull tab therewithin. The process of exposing the loop, engaging the object to be pulled in the loop, and tightening the slide tube end around the loop by slidably moving the slide tube up and down the metal plate and arm is a process of cinching the loop around the object. Thus, the arm with affixed metal plate and button with the slide tube form an assembly capable of cinching an object therewithin.

The dimensions of the present invention facilitate the proper manipulation of the zipper or button to be pulled. Where the it is desired that the tool be used to move a zipper at the back of a garment and where the zipper may extended from near the base of the head, the base of the neck, the top of the back of the garment to below the users waist, the extended length of the tool will vary accordingly. In general, the length from the base of the head to below the waist will be from about 12 to 28 inches or from about 30 to about 70 centimeters (cm). It is assumed that users will be able to move the zipper some of the distance from completely opened to completely closed using either the multipurpose assistance tool or their own manual dexterity. Whereas the handle, the hinge, and the cinching assembly of the tool will form the majority of the extended and cinched length of the multipurpose assistance tool, the sum of the dimensions of the three components should be from about 8 to about 36 inches, from about 9 to about 34 inches, from about 10 to about 34 inches, from about 11 to about 34 inches, from about 12 to about 34 inches, from about 13 to about 34 inches, from about 14 to about 32 inches, about 15 to about 32 inches, from about 15 to about 32 inches, from about 16 to about 33 inches, about 16 to about 32 inches, from about 18 to about 34 inches, or from about 20 to about 34 inches. It will be appreciated that the length of the handle and the length of the cinching assembly need not be of a similar length. The length of the handle may be longer than the length of the cinching assembly or the length of the handle may be shorter than the length of the cinching assembly. In one embodiment, the handle is 7 inches including the cap and the hinge forming component. In one embodiment the cinching assembly comprising the arm with affixed loop is 7 inches. In an embodiment, the multipurpose assisting tool is 7 inches long when in the closed configuration and is 13 inches long when in the open configuration.

The width or cross sectional dimension of the multipurpose assisting tool components will depend on the desired application for the tool, the typical forces required for the tool to perform the action of pulling a zipper, the material used to produce each component, and the desire to have an object which is of minimum weight and folded dimension. In an embodiment the handle will be made of wood, plastic, a polymer, a resin a metal or a metal alloy, paper, or bone. In an embodiment the handle of the tool can be from 0.1 inches to 5 in breadth. In an embodiment, the arm member that hingeably connects to a handle member and is either affixed to the pulling loop or the arm and loop are made as a single piece. The arm and loop member will have an outer width of from 0.2 in to 2 in and an inner width or from 0.1 to 1.9 in. The arm member and the loop member will be of a shape and dimension as to fit within a sliding member for the purpose of forming the cinching assembly, whereby the sliding member moves over the arm to expose more or less of the circumference of the loop.

The pulling loop which is affixed to the arm and cinched can be of a dimension that is suited for pulling a zipper tab or a button, or a tab of a Velcro® fastener, or the like. It may be of rigid material, such as of being an integral part of a stainless steel plate as shown in the embodiment depicted in FIG. 1B and FIG. 6. In an embodiment, the plate comprising the pulling loop is formed from a metal such that the metal is capable of a degree of deformability and acts to reassume its original shape after the force deforming it is removed. In an embodiment, the loop is formed from a stainless steel plate to which a button is affixed, whereby the force on the head of the button transfers to the metal plate and deforms the plate. The loop may also be of a more flexible material such as a woven material, e.g. a cord, or be made of a number of polymeric materials having suitable properties of strength, non-deformability, and durability.

An embodiment of the tool useful for pulling buttons may have modifications such that overall length and width is compatible with the use for pulling buttons at the front, side or back of garment, buttons on footwear, buttons on trousers, or buttons on headgear. Other modifications for various uses of a personal tool according to the invention having a cinching loop will increase or decrease the internal width, the length, or the rigidity of the loop. In other embodiments of the invention, the tool may have more than one hinge allowing for the extension of the length of the handle. In other embodiments the handle may be shorter than the arm and loop together. The handle may be made of a flexible or rigid material according to the preferred use of the tool.

Method of Using the Multipurpose Assistance Tool

In an embodiment of the multipurpose assisting tool, the handle and the arm with cinching loop assembly is a foldable tool allowing for facile storage and transportation within a pocket, bag, or other item that the user may normally have with them. The pull tool may also be stored in a location where it is convenient for the user to use when dressing or undressing.

In an embodiment, in order to use a portable multipurpose assisting tool according to the present invention having a loop cinching feature, the tool is placed in the open or operating configuration by rotating the arm away from handle to fully extend the tool. When a locking cap is present, the cap portion securing the end of slide tube is disengaged prior to extending the tool.

For the purposes of manipulating a zipper, the pull tab of the zipper is inserted into the loop and the loop is cinched around the pull tab as described earlier herein. The garment may be put on with the zipper tool engaged with the zipper or the user may manipulate the tool to engage the zipper after the garment is on or partially on the body of the user.

Once the loop has engaged the zipper tab and the slide tube moved toward the proximal end of the arm portion thereby cinching the loop tightly around the zipper pull, the handle can be moved by the user so as to move the zipper slide along the zipper. Ideally, the handle will be positioned substantially in the direction of travel of the zipper slide. However, the proper dimensional arrangements of the present invention facilitate the ability to use the multipurpose assisting tool with the handle at an angle to the direction of travel or behind the direction of travel. After the zipper has been properly manipulated, opened or closed, the loop can be easily disengaged from the zipper slide by depressing the button or other mechanism in order to move the slide tube towards the distal end of the arm, such as by drawing the button along the slot of the keyhole towards the open end of the slide tube thereby exposing more of the loop.

In the event the user wishes to use the zipper pull tool to pull a button through a button hole, the user may grasp the slide tube and arm assembly, the cinching assembly, inserted it through the buttonhole, extend the loop by moving the button or using any other means to move the slide tube rearward from the tip of the loop, insert the loop over the button to engage the button stem or thread anchoring the button to the garment, and optionally, cinch the loop around the button anchoring means, and pull the loop with the button therewithin through the buttonhole thereby securing the two regions of the garment comprising the button and buttonhole.

Methods of Making the Invention

In aspects of the present invention, the tool will be assembled from components parts according to the embodiments of the invention which are manufactured according methods well known in the art, such as injection molding, extrusion, stamping, milling, 3-dimensional printing, or the like. Alternate methods of manufacture of the component parts allows for the use of materials and shapes suited to the purposes and functionality of each component and feature of the tool as a whole.

The components of the portable multipurpose assisting tool can be manufactured of a wide variety of materials according to the particular need by the user and according to the individual functions of each such as component to satisfy the range of flexibility, durability, appearance, decoration, and workability. For example, the zipper pull handle may be made of an elastomeric polymer so that is both light and has the decided softness and flexibility in the hand of the user.

For example, various forms of acrylonitrile butadiene styrene (ABS), a common thermoplastic, can be used due to its combination of strength, rigidity or hardness, gloss, toughness, and has electrical insulation properties.

Stainless steel which may be anodized to take various colors may also be used. Nonanodized stainless steel is also suitable for forming the loop containing plate affixed to the arm of the tool.

Figure 11:
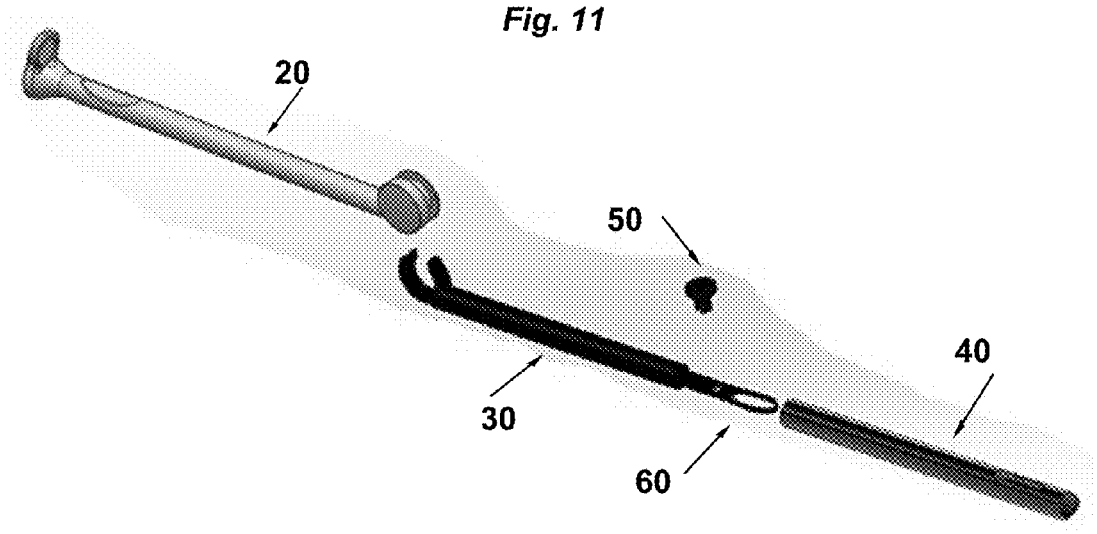
FIG. 11 shows how the component sections of the multipurpose tool are assembled.

Once the components are manufactured the assembly of individual tools can be accomplished by manual or automated methods. In one example of an method of assembly of the member components as shown in FIG. 11, the hinge component 25 of handle 20 (FIG. 3) is snapped into the hinge part 35 of the arm 30 (FIG. 6), the slide tube 40 (FIG. 8) is slid over arm 30 and button 50 (FIG. 10) is snapped into hole 63 of metal plate 60 (FIG. 7) by passing through hole 46 in slide tube 40. The finished tool may then be placed in the closed position as shown in FIGS. 1A and 2 by rotating hinge 70 so that the inner surfaces of slide tube 40, head 51 of button 50, and inner surface 21 of handle 20 are in close proximity and engaging lip 82 of cap portion 80 (FIG. 2) over the open end of slide tube 40 to secure the tool in the closed position for transportation or for inclusion in a package be distributed and offered for sale.

The finished, assembled tool may be part of a kit which includes a description of the use and care of the tool and one or more tools. The kit may comprise a package which is further enclosed in packaging material and printed advertising, the name of the product, and the name of the manufacturer or distributor of the product as required by law. The kit may, optionally, include a container for transporting the personal use tool. The container may be of a soft material or may be comprised of a rigid material. In one embodiment of the invention, a soft bag is provided for use while storing or transporting the personal use tool. In another embodiment, a rigid case is provided for storing or transporting the personal use tool. An embodiment of the invention includes a kit comprising the personal use tool, a container for the tool, and instructions for use.

Stability and Durability

The terms "stability" or "durability" are used interchangeably herein.

Stability can be evaluated by, for example, without limitation, by storage at selected climate conditions for a selected time period, by applying mechanical stress such as shaking at a selected shaking frequency for a selected time period, by irradiation with a selected light intensity for a selected period of time, or by repetitive opening and closing, or repetitive use. The stability of a tool according to the invention may be determined by, for example, without limitation, at least one of the methods selected from the group consisting of visual inspection, loss of tensile strength, disarticulation of some or all of the component parts, or loss of ability to perform its intended function.

While having described the invention in general terms, the embodiments of the invention will be further disclosed in the following examples.

EXAMPLE 1

Manufacture and Assembly of a Multipurpose Assistance Tool

One example of a device of the present invention may be prepared using the methods and material described herein an in the associated figures. An example of a multipurpose assistance tool is illustrated in FIGS. 1A-11 and is made from the components which form a handle, an arm which articulates with the handle, a loop affixed to the arm, and a slidable sheath that moves over the loop opening to expose more or less of the opening.

The handle of the tool is made of a flexible elastomer-80 Shore Ain black and is 5.75 in length, not including the hinge component and the cap component, and 0.4 in width.

The arm center, tubular portion is made of acrylonitrile butadiene styrene (ABS) with a satin finish and the total length not including the hinge component is 4.62 in and has an outer diameter of 0.4 in. The circular hinge component has a diameter of 0.52 in which is molded to the tubular portion at one end.

The metal plate is fabricated from spring steel and is inserted molded into the arm ABS portion. It is 57 mm in length and 1.2 mm (0.05 in) in height. The plate is spoon shaped: has a narrow end and a rounded portion that is cut out to form a loop. The narrow portion has two cutouts; one which is provides a passage to be filled by ABS during the insert molding process which is 4 mm in diameter and 5 mm from the end of the plate, and a second for receipt of a button which is 5.6 mm in across and positioned 28 mm from the end of the plate. The narrow portion is 6.6 mm (0.26 in) wide and 36 mm (1.42 in) long. The loop portion is a symmetrical ellipse shape extending over 21 mm outer length to a maximum width of 9.8 mm (0.39 in). The loop cutout is an ellipse 18 mm long and 6.0 mm at its maximum width, leaving an edge 1.4 mm thick.

A slide tube fabricated from metal which has been anodized to be black or gold in color and is 5 in length with an outer diameter of 11 mm (0.43 in) and an inner diameter of 10.4 mm (0.41 in). One end, which is contour cut, also has a keyhole shape cutout beginning 0.5 in from the end and extending about 1 in along the length of the tube with the largest, rounded portion the most distal from the contour cut end. The round hole has a 0.24 in diameter and is continuous with a slot 0.12 in wide with a rounded end.

The button is molded from ABS with a cap portion and a stem portion. The cap has an outer diameter of 10.7 mm (0.42 in) and the stem portion has a diameter of 5.9 mm (0.23 in). The cap portion fits symmetrically over the stem portion and is 2.6 mm (0.1 in) high. The stem portion has a central bore which may be threaded to receive a screw or the stem portion may have side cutouts shaped for insertion into a suitable receptacle shape. The stem height is designed to pass through the metal slide tube keyhole cutout and be secured in the metal plate which is molded to the arm member to be there secured.

EXAMPLE 2

Panel Testing of the Invention

A study may be conducted, which may enroll a total of 60-200 female subjects aged 40 to 65 years with moderate to moderately severe arthritis. The subjects may be asked to use the zipper pull tool for a defined period and report whether they found the tool helpful.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

It may be advantageous to set forth definitions of certain words and phrases used in this patent document. Additional definitions are set forth throughout the detailed description. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

As used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims. Use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

By "zipper" is meant a device consisting of two flexible strips of metal or plastic with interlocking projections closed or opened by pulling a slide along them, used to fasten garments, bags, and other items, typically having a zipper tab affixed to the slide mechanism allowing the operator to grasp the tab and move the slide to zip (close) or unzip (open) the zipper.

As used herein, a "button" refers to a flattened object affixed to an article that when engaged by an opening within or loop affixed to and located on a distal region of the same or different article serves to maintain the region to which the button is affixed adjacent to the region comprising the hole or loop.

Where the dimensions of a member or a portion of a member are described it is understood that the measurements may be made in any units used in the FPS (foot pounds system) or the metric system. The conversion of feet, having 12 in (inches) per foot to the metric system, assumes that that a meter had 100 cm (centimeters) and 1000 mm (millimeters), and that an inch is approximately 2.54 cm or 254 mm.

Throughout this description, the embodiments and examples shown should be considered as exemplars, rather than limitations on the apparatus and procedures disclosed or claimed. Although many of the examples involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

For means-plus-function limitations recited in the claims, the means are not intended to be limited to the means disclosed in this application for performing the recited function, but are intended to cover in scope any means, known now or later developed, for performing the recited function.

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the invention. Therefore, the scope of this application is intended to cover alternate embodiments and/or equivalent variations of the specific embodiments illustrated and/or described herein. Hence, the scope of the invention is defined by the accompanying claims and their equivalents. Furthermore, each and every claim is incorporated as further disclosure into the specification and the claims are embodiment(s) of the invention.

What is claimed is:

1. A multipurpose personal use tool useful in manipulating a zipper or a button of a garment, having a manually operated cinching loop assembly and a handle; wherein the cinching loop assembly comprises an arm having a distal end and a loop end, wherein the loop end comprises a cinching loop, and, a slideable member capable of moving over the cinching loop; whereby the arm is at least partially within the slideable member, and hingeably connected to the handle at the distal end, such that the arm and handle can be opened to various degrees to obtain corresponding lengths of the tool and corresponding angles between the arm and the handle, to accommodate a location of the zipper or the button of the garment and user's mobility deficiencies.

2. The multipurpose personal use tool of claim 1, wherein the slideable member has a contour cut at one end configured to engage at least a portion of the zipper or the button of the garment after the at least a portion of the zipper or the button of the garment enters the cinching loop, thus providing maximal cinching around the at least a portion of the zipper or the button of the garment.

3. The multipurpose personal use tool of claim 1, whereby the arm is hingeably connected to the handle at the distal end, such that when the arm and handle are in a closed position the tool is of a smaller dimension, making it easily transportable by a user.

4. The multipurpose personal use tool of claim 1, wherein the cinching loop assembly is affixed to a proximal end of the arm and the slideable member moves over the arm to restrict the dimensional opening of the cinching loop, whereby when the cinching loop is used to engage an object on a garment, the slideable member is adjusted by a means of moving the arm in relation to the slideable member by manually moving the arm within the slideable member.

5. The multipurpose personal use tool of claim 4, wherein the cinching loop assembly comprises a substantially rod shaped arm with a cinching loop affixed to the proximal end and a tubular shaped slideable member, slideably positioned over the arm.

6. The multipurpose personal use tool of claim 5, wherein the means for moving the arm within the slideable member is by moving a button affixed to the arm within an opening in the slideable member.

7. The multipurpose personal use tool of claim 6, wherein the opening in the slideable member is a keyhole cutout having a slot portion and a hole portion and wherein the button has a stem having a narrower portion that fits snugly into the slot portion while the remaining portion of the stem fits snugly into the hole portion to lock the arm in place.

8. The multipurpose personal use tool of claim 6, wherein the cinching loop and the tubular shaped slideable member are made from steel.

9. The multipurpose personal use tool of claim 1, wherein the handle is connected to the manually operated cinching loop mechanism by a hinge located at the distal end of the arm selected from the group consisting of a circular hinge, a barrel hinge, a shortened barrel hinge, a ball and socket hinge, and a pivot hinge.

10. The multipurpose personal use tool of claim 1, wherein the handle includes a cap at the end opposite the hinge for engaging and protecting the cinching loop assembly at the loop end of the arm.

11. A method of using a multipurpose personal use tool having a handle and an arm with a cinching loop assembly, wherein the cinching loop assembly comprises an arm having a distal end and a loop end, wherein the loop end comprises a loop, and, a slideable member capable of moving over the loop; whereby the arm is hingeably connected to the handle at the distal end, the method comprising the steps of:

i) opening the tool by extending the arm away from the handle;

ii) encompassing a pull tab of a zipper or a button to be pulled with the loop;

iii) actuating the cinching loop assembly in a manner whereby the cinching loop assembly secures the zipper pull tab or the button by moving the arm in relation to the slideable member, and iv) exerting force on the handle to move the zipper pull tab along the direction of the zipper desired so as to zip or unzip the zipper or to move the button through a hole.

12. A method of making a multipurpose personal use tool of claim 1, comprising the steps of:

i) forming component parts of the tool, the component parts comprising one or more of a handle component, an arm having a distal end and a loop end, and being hingeably connected to the handle component at the distal end, a slideable member, and a button affixed to the arm for actuating the arm within the slideable member having a slot portion and a hole portion, wherein the button has a stem having a narrower portion that fits snugly into the slot portion while the remaining portion of the stem fits snugly into the hole portion to lock the arm in place, and ii) manually assembling the tool from the component parts.

* * * * *